US010017972B1

(12) United States Patent
Page

(10) Patent No.: US 10,017,972 B1
(45) Date of Patent: Jul. 10, 2018

(54) ROLL-FORMED GOOSE NECK HINGE

(71) Applicant: Dura Operating, LLC, Auburn Hills, MI (US)

(72) Inventor: Indraneel Krishna Page, Rochester Hills, MI (US)

(73) Assignee: DURA OPERATING, LLC, Auburn Hills, MI (US)

( * ) Notice: Subject to any disclaimer, the term of this patent is extended or adjusted under 35 U.S.C. 154(b) by 0 days.

(21) Appl. No.: 15/639,481

(22) Filed: Jun. 30, 2017

(51) Int. Cl.
*E05D 5/06* (2006.01)
*E05D 3/02* (2006.01)
*E05D 11/06* (2006.01)

(52) U.S. Cl.
CPC ..... *E05D 5/062* (2013.01); *E05D 3/02* (2013.01); *E05D 11/06* (2013.01); *E05D 2005/067* (2013.01); *E05Y 2600/626* (2013.01); *E05Y 2900/531* (2013.01); *E05Y 2900/536* (2013.01); *E05Y 2900/548* (2013.01)

(58) Field of Classification Search
CPC ..... E05D 11/04; E05D 11/045; E05D 11/06; E05D 11/1085; E05D 11/1007; E05D 2005/067; E05D 5/062; E05D 3/127; E05D 3/145; E05D 3/18; E05D 3/12; E05Y 2900/502; E05Y 2900/50; E05Y 2900/548; E05Y 2900/536; E05Y 2900/546; E05Y 2900/531; E05Y 2201/416; E05F 1/123; E05F 1/1238; E05F 1/1033; E05F 1/1276; E05F 1/1284; E05F 5/022; Y10T 16/5402; Y10T 16/54024; Y10T 16/540247; Y10T 16/54026; Y10T 16/54048; Y10T 16/5049; Y10T 16/53885; Y10T 16/5389; Y10T 16/53834; Y10T 16/5385
See application file for complete search history.

(56) References Cited

U.S. PATENT DOCUMENTS 2,143,736 A 1/1939 Lefevre
2,947,025 A * 8/1960 Campbell ..... E05D 1/04 16/275
3,067,453 A 12/1962 Lyons
4,580,315 A 4/1986 Beckwith
4,893,863 A * 1/1990 Skonieczny ..... E05D 7/0045 16/235
5,074,609 A * 12/1991 Dear ..... E05D 7/0045 16/235

(Continued)

*Primary Examiner* — Chuck Mah
(74) *Attorney, Agent, or Firm* — Robert E. Ford; Raymond J. Vivacqua; Steven L. Crane

(57) ABSTRACT

A goose neck hinge assembly for a motor vehicle includes a base portion extending from a panel attachment portion to a hinge portion, the base portion having a substantially rectangular cross section. The goose neck hinge assembly further includes a mounting bracket mounted to the motor vehicle and rotatably connected to the hinge portion of the base portion. The base portion has a first structural element includes a first material with a first material thickness and a second structural element includes a second material with a second material thickness. The first material thickness is different than the second material thickness. The first structural element forms a substantially U-shaped portion of the substantially rectangular cross section and defines a longitudinal gap, and the second structural element is disposed over the longitudinal gap.

21 Claims, 3 Drawing Sheets

(56) References Cited

U.S. PATENT DOCUMENTS

| | | | | |
|---|---|---|---|---|
| 5,419,012 | A * | 5/1995 | Lewis | E05D 3/10 16/306 |
| 5,584,099 | A * | 12/1996 | Westerdale | E05D 5/062 16/235 |
| 6,382,704 | B1 * | 5/2002 | Nastasoiu | E05D 5/062 16/298 |
| 7,536,748 | B2 | 5/2009 | Renke et al. | |
| 8,518,234 | B2 | 8/2013 | Rakowski | |
| 2005/0172453 | A1 * | 8/2005 | Duffy | E05D 5/062 16/307 |
| 2006/0230578 | A1 * | 10/2006 | Renke | E05D 5/062 16/289 |
| 2008/0018131 | A1 * | 1/2008 | Heath | E05D 5/062 296/76 |
| 2011/0277273 | A1 * | 11/2011 | Mildner | E05D 5/06 16/251 |
| 2013/0042435 | A1 * | 2/2013 | Schott | E05D 5/062 16/321 |
| 2013/0119698 | A1 * | 5/2013 | Patzer | E05D 5/062 296/146.12 |
| 2016/0362926 | A1 * | 12/2016 | Dey | E05D 11/1014 |

* cited by examiner

ROLL-FORMED GOOSE NECK HINGE

FIELD

The invention relates generally to goose neck hinges for vehicles, and more particularly to roll-formed goose neck hinges for attaching a trunk lid to a body of a vehicle.

BACKGROUND

The statements in this section merely provide background information related to the present disclosure and may or may not constitute prior art.

Motor vehicles have been designed with a variety of different closures such as a deck lid to open and close a rear compartment or trunk. Typically, the deck lid is attached to a vehicle body of the motor vehicle with at least one, preferably a pair of laterally spaced hinges. Currently, the deck lid hinges are of a goose-neck type for allowing motion of the deck lid from a fully open position to a fully closed position, and for counterbalancing a weight of the deck lid. Because deck lid hinges must support the weight of the deck lid, certain properties such as strength and rigidity/stiffness are desirable. However, achieving strength and stiffness targets at low overall cost often means that deck lid hinges can be quite heavy. Accordingly, there is a need in the art for an improved deck lid hinge produced by simplified production processes, and having reduced cost of production, reduced materials cost, and reduced weight while maintaining or improving upon rigidity and strength characteristics.

SUMMARY

In one aspect of the present disclosure a goose neck hinge assembly for a motor vehicle includes a base portion extending from a panel attachment portion to a hinge portion, the base portion having a substantially rectangular cross section. The goose neck hinge assembly further includes a mounting bracket mounted to the motor vehicle and rotatably connected to the hinge portion of the base portion. The base portion has a first structural element includes a first material with a first material thickness and a second structural element includes a second material with a second material thickness. The first material thickness is different than the second material thickness. The first structural element forms a substantially U-shaped portion of the substantially rectangular cross section and defines a longitudinal gap, and the second structural element is disposed over the longitudinal gap.

In another aspect of the present disclosure the substantially U-shaped portion defined by the first structural element further includes a semi-closed U-shaped portion having a first wall connected to a second wall, the second wall connected to a third wall, the third wall connected to a fourth wall, and the fourth wall connected to a fifth wall. The first and the fifth walls extend towards each other and define the longitudinal gap.

In yet another aspect of the present disclosure at least one of the first structural element and the second structural element are roll-formed from sheet metal stock, and the first structural element and the second structural element are bonded together, stretched, and bent into a predetermined shape having a lateral bend.

In yet another aspect of the present disclosure the first material is different than the second material.

In yet another aspect of the present disclosure the base portion further includes a first section extending from the hinge portion to a second curvilinear section. The second section extends from the first section to a third section, and the third section extends from the second section to the panel attachment portion.

In yet another aspect of the present disclosure the first section is substantially straight, the second section is substantially curvilinear, and the third section is substantially straight.

In yet another aspect of the present disclosure the first structural element is mechanically affixed to the second structural element.

In yet another aspect of the present disclosure the first structural element is chemically bonded to the second structural element.

In yet another aspect of the present disclosure the first material thickness is greater than the second material thickness.

In yet another aspect of the present disclosure the first structural element includes a plurality of attachment features for attaching the third section of the base portion to a moveable body panel of the motor vehicle.

In yet another aspect of the present disclosure the first structural element includes hinge attachment features accepting a pivot pin extending from the mounting bracket.

In yet another aspect of the present disclosure a goose neck hinge assembly for a motor vehicle includes a base portion extending from a panel attachment portion to a hinge portion, the base portion having a substantially rectangular cross section. The goose neck hinge assembly further includes a mounting bracket mounted to the motor vehicle and rotatably connected to the hinge portion of the base portion. The base portion has a first structural element including a first material with a first material thickness and a second structural element including a second material with a second material thickness different than the first material thickness. The first structural element forms a substantially U-shaped portion of the substantially rectangular cross section and defines a first longitudinal gap. The second structural element forms a substantially U-shaped portion of the substantially rectangular cross section and defines a second longitudinal gap. The first structural element is disposed within the second longitudinal gap and the second structural element is disposed over the longitudinal gap of the first structural element.

In yet another aspect of the present disclosure at least one of the first structural element and the second structural element is roll-formed from sheet metal stock, stretched, and bent into a predetermined shape, wherein the predetermined shape includes a lateral bend, and the first structural element is mechanically or chemically affixed to the second structural element.

In yet another aspect of the present disclosure the base portion further includes a first section extending from the hinge portion to a second curvilinear section, and the second section extends from the first section to a third section, and the third section extends from the second section to the panel attachment portion, and the first section is substantially straight, the second section is substantially curvilinear, and the third section is substantially straight.

In yet another aspect of the present disclosure the first material is different than the second material.

In yet another aspect of the present disclosure the first structural element includes a plurality of attachment features for attaching the third section of the base portion to a moveable body panel of the motor vehicle.

In yet another aspect of the present disclosure the first structural element includes hinge attachment features accepting a pivot pin extending from the mounting bracket.

In yet another aspect of the present disclosure the goose neck hinge assembly further includes a flexible bumper disposed on a top surface of the base portion proximate the hinge portion, wherein the flexible bumper limits rotation of the base portion relative to the motor vehicle.

In yet another aspect of the present disclosure the mounting bracket is a metal extrusion having a substantially cylindrical central section integrally formed with a substantially planar flange. The substantially cylindrical central section defines an inner substantially cylindrical passage for accepting a hinge pin. The substantially planar flange extends radially outward from substantially cylindrical central section, and the substantially planar flange includes a plurality of attachment features for attaching the mounting bracket to the motor vehicle.

In yet another aspect of the present disclosure a goose neck hinge assembly for a motor vehicle includes a base portion extending from a panel attachment portion to a hinge portion, the base portion having a substantially rectangular cross section. The goose neck hinge assembly further includes a mounting bracket mounted to the motor vehicle and rotatably connected to the hinge portion of the base portion. The base portion has a first roll-formed structural element with a first material thickness bonded to a second roll-formed structural element with a second material thickness different than the first material thickness. The first roll-formed structural element forms a substantially U-shaped portion of the substantially rectangular cross section and defines a first longitudinal gap, and the second roll-formed structural element forms a substantially U-shaped portion of the substantially rectangular cross section and defines a second longitudinal gap. The first roll-formed structural element is disposed within the second longitudinal gap, and the second roll-formed structural element is disposed over the first longitudinal gap. The mounting bracket is an extrusion having an inner substantially cylindrical component concentrically and integrally extruded with an outer substantially cylindrical component and a substantially planar flange. The inner substantially cylindrical component accepts the hinge pin, and the outer substantially cylindrical component is connected to the inner substantially cylindrical component by a plurality of radial ribs. The substantially planar flange extends radially outward from the outer substantially cylindrical component and includes a plurality of attachment features attaching the mounting bracket to the motor vehicle.

Further aspects, examples, and advantages will become apparent by reference to the following description and appended drawings wherein like reference numbers refer to the same component, element or feature.

BRIEF DESCRIPTION OF THE DRAWINGS

The drawings described herein are for illustration purposes only and are not intended to limit the scope of the present disclosure in any way. The components in the figures are not necessarily to scale, emphasis instead being placed upon illustrating the principles of the invention. Moreover, in the figures, like reference numerals designate corresponding parts throughout the views.

DETAILED DESCRIPTION

The following description is merely exemplary in nature and is not intended to limit the present disclosure, application or uses.

Figure 1A:
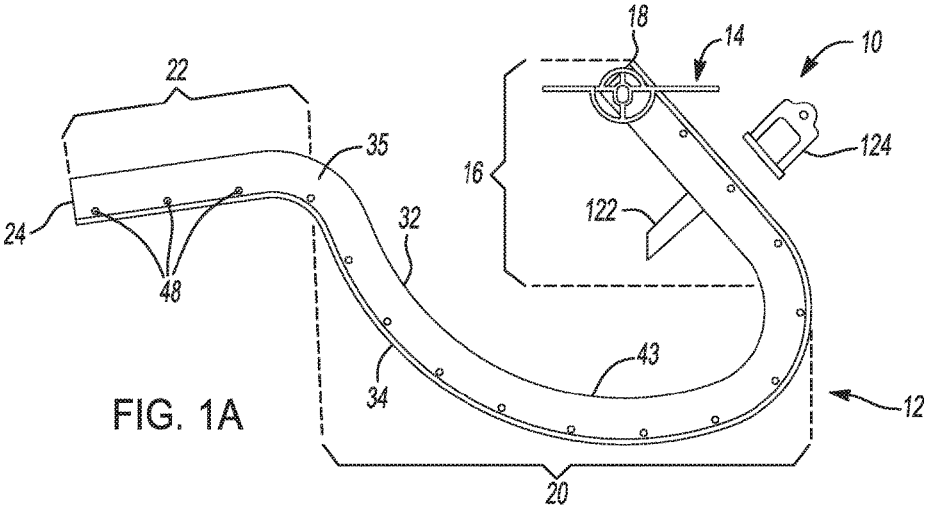
FIG. 1A is a side view of a goose neck hinge assembly according to the principles of the present disclosure.
Figure 1B:
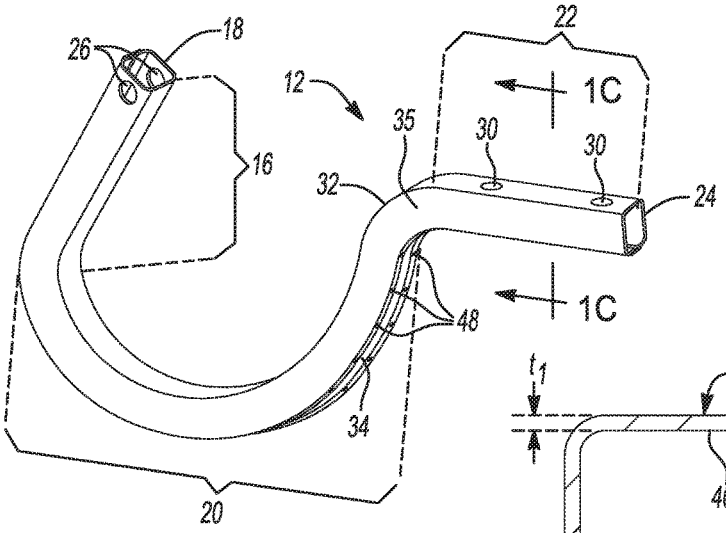
FIG. 1B is a perspective side view of a portion of an example of a goose neck hinge assembly according to the principles of the present disclosure.
Figure 1C:
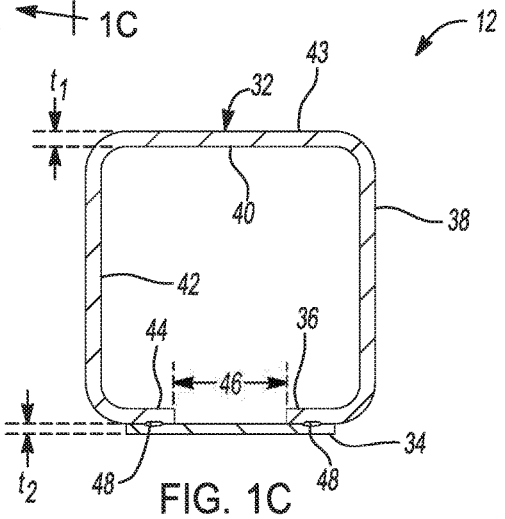
FIG. 1C is a cross-sectional front view taken along section line 1C-1C of an example of the goose neck hinge assembly of FIG. 1A according to the principles of the present disclosure.

With reference to FIGS. 1A-1C, a first example of a goose neck hinge assembly is shown and generally indicated by reference number 10. The goose neck hinge assembly 10 is preferably used in a vehicle, for example a passenger vehicle, truck, sport utility vehicle, van, motor home, or any other type of vehicle without departing from the scope or intent of the present disclosure. More specifically, the goose neck hinge assembly 10 is used in a body opening or recess of the vehicle (not shown). That is, a body panel (not shown), such as a trunk lid, deck lid, hood, door, or the like is attached to a corresponding compartment (not shown) of the vehicle body by at least one, and preferably at least a pair of spaced goose neck hinge 10 assemblies.

The goose neck hinge assembly 10 includes a base portion 12 and a mounting bracket 14. The base portion 12 has a generally rectangular cross section and includes a first section 16 that is generally straight and extends from a first end 18 of the base portion 12 to a second section 20. While the base portion 12 is shown and described with respect to FIGS. 1A-1C as having a generally rectangular cross section, it should be understood that depending on the application for which the goose neck hinge assembly 10 is intended, the cross section of the base portion 12 may take other forms. For example, the base portion 12 may have a triangular, pentagonal, hexagonal, octagonal, ovoid, or oblong shape, etc. without departing from the scope or intent of the present disclosure. The second section 20 is generally curvilinear in shape, and extends from the first section to a third section 22. The third section 22 is generally straight and extends from the second section 20 to a second end 24 of the base portion 12. The first section 16 also includes first attachment features 26 for attaching the base portion 12 of the goose neck hinge assembly 10 to the vehicle via the mounting bracket 14. More specifically, the first attachment features 26 are optimally shaped and sized to support a pivot member (not shown) such as a rod, pin, spring pin, or the like. Similarly, the third section 22 includes second attachment features 30 for attaching the base portion 12 of the goose neck hinge assembly 10 to the deck lid of the vehicle. In one aspect, the second attachment features 30 are optimally shaped and sized to accept mechanical fasteners such as screws, bolts, rivets, interference fittings, and the like. In another aspect, the second attachment features 30 include adhesive materials (not shown), such as epoxies, polyurethane, polysulfide, acrylic anaerobic, cyanoacrylate, polyamide, latex and silicone elastomeric adhesives, and the like. Moreover, in some aspects, the second attachment features 30 may be adapted to accept both mechanical fasteners and adhesive materials.

With continued reference to FIGS. 1A and 1B, and with particular reference to FIG. 10, the base portion 12, is formed of a first structural element 32 disposed overtop a second structural element 34. The first structural element 32 is roll-formed from sheet metal stock, stretched, and bent into a first desired shape. In one aspect, the first desired shape includes a lateral bend 35 located approximately where the second section 20 and the third section 22 meet.

The first structural element 32 has a generally semi-closed U-shaped cross section and has a first material thickness "$t_1$". More specifically the generally semi-closed U-shaped cross section of the first structural element 32 includes a first wall 36 connected at an angle to a second wall 38. The second wall 38 is connected at an angle to a third wall 40. The third wall 40 is connected at an angle to a fourth wall 42 and forms an upper surface 43 of the first structural element 32 and the base portion 12. The fourth wall 42 is connected at an angle to a fifth wall 44. Therefore, as can be seen in FIG. 10, the first wall 36 and the fifth wall 44 extend toward one another and define a gap 46. That is, if the first and fifth walls 36, 44 were allowed to continue to extend towards one another meet, rather than define the gap 46, the resulting cross section of the first structural element 32 would be rectangular in shape.

The second structural element 34 has a generally flat profile and a second material thickness "$t_2$". Depending on the application for which the goose neck hinge assembly 10 is intended, the material composition of the first structural element 32 and the second structural element 34 may be the same, or different. That is, depending on structural requirements, manufacturing tolerances, and the like, the first and second structural elements 32, 34 may be made of the same metal, different grades of metal, or even from entirely dissimilar materials such as a metal and a composite, etc. without departing from the scope or intent of the present disclosure. In one aspect, the second structural element 34 is disposed externally to the gap 46 of the semi-closed U-shaped first structural element 32. The second structural element 34 is roll-formed from sheet metal stock and/or stamped, cut, laser cut, machine cut, or the like into a strip, and affixed to the first structural element 32. In several aspects, the second structural element 34 is bonded to the first structural element 32 by a plurality of bonds 48 formed by welding, braising, gluing, bolting, or the like.

In several aspects, when the goose neck hinge assembly 10 is used with a trunk lid, or deck lid of a vehicle, the first structural element 32 forms the upper surface 43 of the base portion 12. Because the upper surface 43 of the base portion 12 includes the first attachment features 26 of the first section 16 and the second attachment features 30 of the third section 22, the first structural element 32 is mechanically optimized to support the deck lid of the vehicle. That is, the first structural element 32 is designed to support the deck lid without deforming over time, and with repeated use. More specifically, the first material thickness "$t_1$" of the first structural element 32 is greater than the second material thickness "$t_2$" of the second structural element 34. Furthermore, because the first material thickness "$t_1$" is greater than the second material thickness "$t_2$", the second structural element 34 is substantially more flexible than the first structural element 32. Accordingly, the second structural element 34 is bonded to the first structural element 32 after the first structural element 32 has been bent into the first desired shape.

It should be understood that while the lateral bend 35 has been described as being located substantially where the second and third sections 20, 22 meet, the exact location, three-dimensional orientation, and angle of the lateral bend 35 may vary. In one example, an axis of the lateral bend 35 is located at, or proximate to the leading edge of the movable body panel of the motor vehicle, and is oriented substantially vertically through the base portion 12 where the second and third sections 20, 22 meet. In the example, the lateral bend 35 causes the third section 22 to extend out of a plane defined by the base portion 12. In a further example, two goose neck hinge assemblies 10 are used with a deck lid of a motor vehicle. The goose neck hinge assemblies 10 are located substantially at or near an outboard left edge, and an outboard right edge of the deck lid. The lateral bend 35 of the base portion 12 of the left-most goose neck hinge assembly 10 causes second end 24 to extend towards a centerline of the motor vehicle. Similarly, the lateral bend 35 of the base portion 12 of the right-most goose neck hinge assembly 10 causes the second end 24 to extend toward the centerline of the motor vehicle. Thus, the second ends 24 of the two goose neck hinge assemblies 10 may be angled inward, toward the centerline of the motor vehicle, thus allowing the deck lid to have a shape that tapers towards its rearmost edge. While the goose neck hinge assemblies 10 of the above example are angled inwardly toward one another, it should be understood that depending on the application, it may be desirable for the goose neck hinge assemblies 10 to be splayed outward, or parallel to one another instead.

Figure 2A:
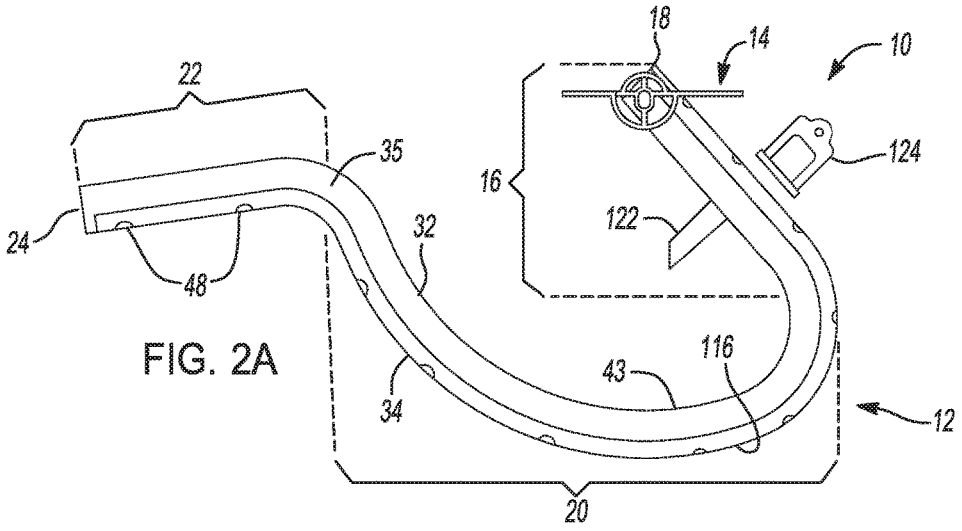
FIG. 2A is a side view of a goose neck hinge assembly according to the principles of the present disclosure.
Figure 2B:
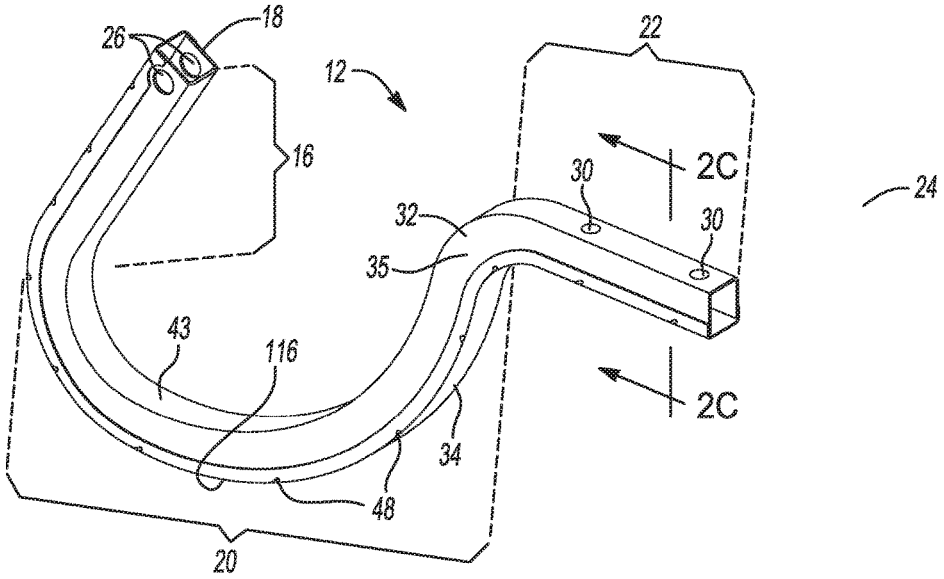
FIG. 2B is a side view of a portion of the goose neck hinge assembly of FIG. 2A according to the principles of the present disclosure.
Figure 2C:
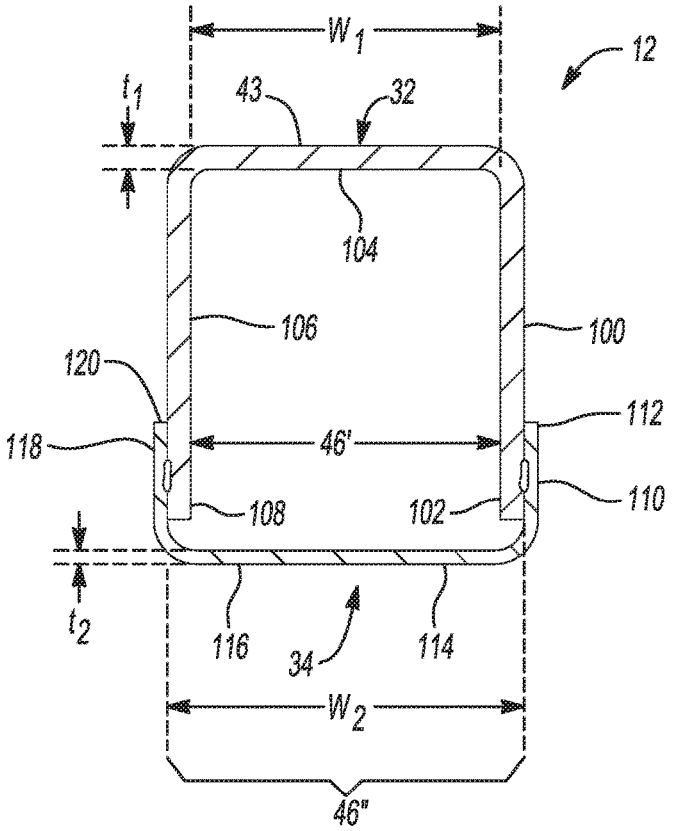
FIG. 2C is a cross-sectional front view taken along section line 2C-2C of an example of the goose neck hinge assembly of FIG. 2A according to the principles of the present disclosure.

Turning now to FIGS. 2A-2C, a second example of a goose neck hinge assembly 10 according to the present disclosure is shown. The goose neck hinge assembly 10 of FIGS. 2A-2C is generally similar to the goose neck hinge assembly 10 of FIGS. 1A-1C, except for the cross sectional shapes of the first structural element 32 and the second structural element 34. Therefore, like components are indicated by like reference numbers.

The goose neck hinge assembly 10 includes a base portion 12 and a mounting bracket 14. The base portion 12 has a generally rectangular cross section and includes a first section 16 that is generally straight and extends from a first end 18 of the base portion 12 to a second section 20. As with the first example of the goose neck hinge assembly 10 of FIGS. 1A-10, while the base portion 12 of FIGS. 2A-2C is shown and described as having a generally rectangular cross section, it should be understood that depending on the application for which the goose neck hinge assembly 10 is intended, the cross section of the base portion 12 may take other forms. For example, the base portion 12 may have a triangular, pentagonal, hexagonal, octagonal, ovoid, or oblong shape, etc. without departing from the scope or intent of the present disclosure. The second section 20 is generally curvilinear in shape, and extends from the first section 16 to a third section 22. The third section 22 is generally straight and extends from the second section 20 to a second end 24 of the base portion 12. The first section 16 also includes first attachment features 26 extending laterally across the first section 16, for attaching the base portion 12 of the goose neck hinge assembly 10 to the vehicle via the mounting bracket 14. More specifically, the first attachment features 26 are optimally shaped and sized to support a pivot member (not shown) such as a rod, pin, spring pin, or the like. Similarly, the third section 22 includes second attachment features 30 extending substantially vertically through the third section 22 for attaching the third section 22 of the base portion 12 of the goose neck hinge assembly 10 to the deck lid of the vehicle. In one aspect, the second attachment features 30 are optimally shaped and sized to accept mechanical fasteners (not shown) such as screws, bolts, rivets, interference fittings, and the like. In another aspect, the second attachment features 30 include adhesive materials (not shown), such as epoxies, polyurethane, polysulfide, acrylic anaerobic, cyanoacrylate, polyamide, latex and silicone elastomeric adhesives, and the like. Moreover, in some aspects, the second attachment features 30 may be adapted to accept both mechanical fasteners and adhesive materials.

While the first attachment features 26 are described as extending laterally across the first section 16, and the second attachment features 30 are described as extending vertically through the third section 22, it should be understood that depending on the application for which the goose neck hinge assembly 10 is intended, the locations, shapes, sizes, and orientations of the first and second attachment features 26, 30 may vary. For example, if the deck lid of the motor vehicle includes a laterally-extending feature adapted to interface with the second end 24 of the base portion 12, the second attachment features 30 may extend laterally through the second end 24 of the base portion 12 rather vertically through the second end 24 of the base portion 12.

With continued reference to FIGS. 2A and 2B, and with particular reference to FIG. 2C, the base portion 12, is formed of a first structural element 32 disposed above, in oppositional contact with a second structural element 34. It should be understood that while the first structural element 32 is depicted in FIGS. 2A-2C as nesting within the second structural element 34 that depending on the application or manufacturing tolerances, the second structural element 34 may instead be nested within the first structural element 32. Likewise, the first and second structural elements 32, 34 may be offset so that along one side of the base portion 12, the first structural element 32 is outside the second structural element 34, and along the opposite side of the base portion 12, the second structural element 34 is outside the first structural element 32. The first structural element 32 is roll-formed from sheet metal stock, stretched, and bent into the first desired shape. In one aspect, and as previously described with respect to FIGS. 1A-10, the first desired shape includes a lateral bend 35 located approximately where the second section 20 and the third section 22 meet.

The first structural element 32 has a generally U-shaped cross section and has a first material thickness "$t_1$". More specifically the generally U-shaped cross section of the first structural element 32 includes a first wall 100 extending from a free end 102 to a second wall 104. The second wall 104 is connected at an angle to the first wall 100. The second wall 104 defines an upper surface 43 of the first structural element 32 and the base portion 12. The second wall 104 also extends for a first width "$w_1$" from the first wall 100 to a third wall 106. The third wall 106 is connected at an angle to the second wall 104, and extends from the second wall 104 to a free end 108. Therefore, as can be seen in FIG. 2C, the free ends 102, 108 of the first wall and the third wall 100, 106 define a first gap 46'. The first gap 46' parallels and extends for substantially the same distance as the first width "$w_1$" of the second wall 104.

Like the first structural element 32, the second structural element 34 has a generally U-shaped cross section, and a second material thickness "$t_2$". Depending on the application for which the goose neck hinge assembly 10 is intended, the material composition of the first and second structural elements 32, 34 may be the same or different. That is, depending on structural requirements, manufacturing tolerances, and the like, the first and second structural elements 32, 34 may be made of the same metal, different grades of metal, or even from entirely dissimilar materials such as a metal and a composite, etc. without departing from the scope or intent of the present disclosure.

The generally U-shaped cross section of the second structural element 34 includes a first wall 110 extending from a free end 112 to a second wall 114. The second wall 114 is connected at an angle to the first wall 110. The second wall 114 defines a lower surface 116 of the second structural element 34 and the base portion 12. The second wall 114 also extends for a second width "$w_2$" from the first wall 110 to a third wall 118. The third wall 118 is connected at an angle to the second wall 114, and extends from the second wall 114 to a free end 120. Therefore, as can be seen in FIG. 2C, the free ends 112, 120 of the first wall and the third wall 110, 118 define a second gap 46". The second gap 46" parallels and extends for substantially the same distance as the second width "$w_2$" of the second wall 114.

In one aspect, the second width "$w_2$" is greater than the first width "$w_1$" so that the first structural element 32 fits within the second structural element 34. That is, the first structural element 32 is disposed in opposition to and within the second structural element 34. More specifically, the first and third walls 100, 106 of the first structural element 32 fit into the second gap 46" of the second structural element 34. The free ends 102, 108 of the first and third walls 100, 106 of the first structural element 32 are therefore disposed proximate to the second wall 114 of the second structural element 34, and interior to the first and third walls 110, 118 of the second structural element 34. In other words, second gap 46" is sized to internally accept the first structural element 32. The first and third walls 110, 118 of the second structural element 34 extend around the first structural element 32. The free ends of the first and third walls 112, 120 of the second structural element 34 are therefore disposed proximate to the second wall 104 of the first structural element 32 and external to the first and third walls 100, 106 of the first structural element 32. While the second structural element 34 is described as having a second gap 46" that is sized to internally accept the first structural element 32, it should be understood that in some applications it may be preferable that the first gap 46' be sized to internally accept the second structural element 34. Similarly, in several aspects the first and second gaps 46', 46" may be equally sized such that the first and second structural elements 32, 34 are joined together with the first structural element 32 is exterior to the second structural element 34 along one side of the base portion 12 while the second structural element 34 is external to the first structural element 32 along the opposite side of the base portion 12.

Like the first structural element 32, the second structural element 34 is roll-formed from sheet metal stock, stretched, and bent into a second desired shape. In some aspects, the second desired shape is a mirror image of the first desired shape so that the first and second structural elements 32, 34 may be joined together along their entire lengths. However, depending on the application for which the goose neck hinge assembly 10 is intended, the shapes of the first and second structural elements 32, 34 may vary. In one aspect, the free ends 102, 108 of the first structural element 32 may not extend fully to and engage with the second wall 114 of the second structural element 34. For example, if an overall height (not shown) of the base portion 12 is 25 mm, and the first structural element 32 has a 20 mm height (not shown), the second structural element 34 may have a height (not shown) of only 10 mm so that the first structural element 32 is only accepted 5 mm deep within the second structural element 34. Additionally, the first and second structural elements 32, 34 may have different overall lengths such that the first and third sections 16, 22 of the first structural element 32 may extend substantially beyond the first and third sections 16, 22 of the second structural element 34, or vice versa. The second structural element 34 is affixed to the first structural element 32. In several aspects, the second structural element 34 is bonded to the first structural element 32 by a plurality of bonds 48 formed by welding, braising, gluing, bolting, or the like.

As with the goose neck hinge assembly 10 of FIGS. 1A-1C, the goose neck hinge assembly 10 of FIGS. 2A-2C is used with a trunk lid, or deck lid of a vehicle, and the first structural element 32 forms the upper surface 43 of the base portion 12. Because the upper surface 43 of the base portion 12 includes the first attachment features 26 of the first section 16 and the second attachment features 30 of the third section 22, the first structural element 32 is mechanically optimized to support the deck lid of the vehicle. That is, in several aspects, base portion 12 is designed to support the deck lid without deforming over time, and with repeated use. In one aspect, the first material thickness "$t_1$" of the first structural element 32 is greater than the second material thickness "$t_2$" of the second structural element 34. In another aspect, the second material thickness "$t_2$" of the second structural element 34 is greater than the first material thickness "$t_1$" of the first structural element 32. In yet another aspect, the first and second material thicknesses "$t_1$", "$t_2$" are substantially equal to one another. Put another way, depending on the application for which the goose neck hinge assembly 10 is intended, the specific and relative material thicknesses "$t_1$" and "$t_2$" may vary. For example, in some instances the material composition of the first structural element 32 may differ from the material composition of the second structural element 34. In the example, the second structural element 34 may be made of aluminum alloy and therefore have higher strength and rigidity for its thickness "$t_2$" and weight than the first structural element 32 if the first structural element 32 is made of a heavier steel alloy. In another example, the first structural element 32 may be made of aluminum alloy and the second structural element 34 may be made of steel alloy, and the strength and rigidity properties, thickness, and weight properties of the first and second structural elements 32, 34 would be reversed with respect to one another. While the first and second structural elements 32, 34 are variously described as being made of aluminum alloy or steel alloy, it should be appreciated that they may instead be formed from any of a variety of other appropriate materials such as magnesium alloys, titanium alloys, high strength steel alloys, stainless steel, plastics, and the like without departing from the scope or intent of the present disclosure.

The goose neck hinge assembly 10 may be equipped with additional features for limiting rotational freedom of the base portion 12 relative to the motor vehicle. In one example, the additional features include first flexible bumpers 122 disposed on a top surface of the base portion 12 proximate the hinge portion 200. In the example, the first flexible bumpers 122 limit rotation of the base portion 12 relative to the motor vehicle as the goose neck hinge assembly 10 is manipulated into an open position. In another example, second flexible bumpers 124 may be equipped to the motor vehicle itself, such that as the goose neck hinge assembly 10 is manipulated into a closed position, body damage is avoided and body panel alignment is properly maintained.

Figure 3:
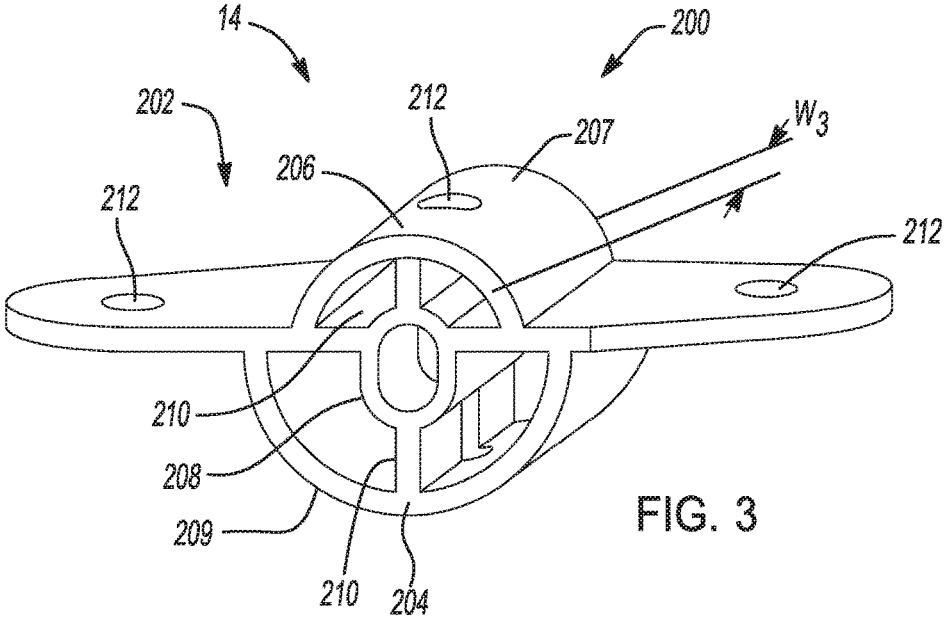
FIG. 3 is a perspective side view of a mounting bracket for the goose neck hinge assembly of FIGS. 1A-2C according to the principles of the present disclosure.

Turning now to FIG. 3, and with continuing reference to FIGS. 1A and 2A, the mounting bracket 14 will now be described in more detail. The mounting bracket 14 is formed via horizontal extrusion. In one aspect, the material from which the mounting bracket 14 is extruded may be aluminum, steel, magnesium, and alloys of the same, as well as composite materials without departing from the scope or intent of the present disclosure. The mounting bracket 14 has a width "$W_3$". The width "$W_3$" of the mounting bracket 14 may vary depending on the application for which the goose neck hinge assembly 10 is intended. The mounting bracket 14 includes a hinge portion 200 and a flange portion 202. The hinge portion 200 is substantially cylindrical in shape. The flange portion 202 extends laterally from the hinge portion 200 and is substantially planar. The hinge portion 200 has a first outer section 204 that is substantially semi-circular extends out of the flange portion 202. The hinge portion 200 has a second outer section 206 that is also substantially semi-circular and extends out of the flange portion 202 directly opposite the first outer section 204. In other words, the first and second outer sections 204, 206 form a substantially cylindrical section of the mounting bracket 14 extending out of the substantially planar flange portion 202. In some aspects a radius of the first outer section 204 may differ from a radius of the second outer section 206. For example, the radius of the first outer section 204 may be smaller than the radius of the second outer section 206 due to packaging constraints, structural requirements, etc. When used with an exemplary deck lid, the first outer section 204 forms a top surface 207 of hinge portion 200, and the second outer section 206 forms a bottom surface 209 of the hinge portion 200.

The hinge portion 200 also has an inner portion 208 disposed concentrically within the first and second outer sections 204, 206. The inner portion 208 is supported within the first and second outer sections 204, 206 by a plurality of radially-outwardly extending strut sections 210. The inner portion 208 is optimally shaped to support a pivot member (not shown) such as a rod, pin, spring pin, or the like. The inner portion 208 may also support a spring bracket (not shown) that, for example provides a motor vehicle operator with spring assistance in opening a deck lid, and resisting closure of the deck lid. In one aspect, the inner portion 208 is substantially cylindrical in shape and has a substantially circular cross section. In another aspect, the inner portion 208 has a substantially cylindrical shape with an ovoid or "stadium" shaped cross section. A stadium shape is a rectangle having a pair of semi-circles positioned at opposite ends.

The mounting bracket 14 also includes a plurality of attachment points 212. The attachment points 212 are located in both the flange portion 202 and the hinge portion 200. In one aspect, the attachment points 212 are a plurality of holes for affixing the mounting bracket 14 to a vehicle via mechanical fasteners such as screws, rivets, bolts, and the like, or other bonding means such as glue, welding, braising or the like. The attachment points 212 are optimally located on the flange portion 202 and the hinge portion 200 for providing structural rigidity, strength, and robustness to the overall goose neck hinge assembly 10. In one aspect, the attachment points 212 are formed by stamping, drilling, tapping, or the like after the mounting bracket 14 has been extruded. Subsequently, the attachment points 212 are affixed to the motor vehicle body by mechanical fasteners, or other bonding means, while the hinge portion 200 is rotatably connected to the base portion 12 of the goose neck hinge assembly 10 by a pivot member (not shown) such as a rod, pin, spring pin, or the like.

The first and second examples of the goose neck hinge assembly 10 of the present disclosure offer a variety of advantages. As shown in the Mass Comparison of Table 1, relative to a generic baseline goose neck hinge assembly, the present goose neck hinge assembly 10 offers substantial weight savings not only with respect to the base portion 12, but with respect to the mounting bracket 14, and the flexible bumpers 122.

TABLE 1

| Mass Comparison | Baseline | FIGS. 1A-1C | FIGS. 2A-2C |
|---|---|---|---|
| Total mass of System (Kg) | 1.65 | 1.22 | 1.13 |
| % Mass Saved w.r.t. to Baseline | NA | 26.08 | 31.37 |
| Goose Neck Hinge Link (g) | 1304 | 1032 (−20.81%) | 945 (−27.51%) |
| Mounting Brackets (g) | 216 | 90 (−58.33%) | 90 (−58.33%) |
| Flexible Bumper (g) | 40 | 9 (−77.55%) | 9 (−77.55%) |
| Spring Bracket (g) | 85 | 85 (0%) | 85 (0%) |

Similarly, as shown in the exemplary performance comparison data of Table 2, the goose neck hinge assembly 10 of the present disclosure offers bending resistance characteristics similar to the baseline goose neck hinge assembly.

TABLE 2

| Performance Comparison | Baseline | FIGS. 1A-1C | FIGS. 2A-2C |
|---|---|---|---|
| Stiffness Load Case Displacement (mm) | 0.78 | 1.15 (0.37) | 1.4 (0.62) |
| Stiffness Load Case (N/mm) | 1149.00 | 826.45 (−28%) | 714.29 (−38%) |
| Decklid Loadcase X-Z (mm) | 0.78 | 1.54 (0.76) | 1.45 (0.67) |
| Decklid Loadcase Y-Z (mm) | 1.32 | 2.25 (0.93) | 2.49 (1.17) |

Thus, for example, the goose neck hinge assembly 10 of FIGS. 1A-10 offers greater than 25% weight savings over the baseline while substantially maintaining bending resistance, stiffness, and strength. Likewise, the goose neck hinge assembly 10 of FIGS. 2A-2C offers greater than 30% weight savings over the baseline while substantially maintaining desirable structural characteristics. Depicted in another manner in Tables 3 and 4, the goose neck hinge assemblies 10 of FIGS. 1A-2C offer substantial weight savings while reducing materials costs and maintaining performance and process targets.

TABLE 3

| | Baseline | FIGS. 1A-1C | FIGS. 2A-2C |
|---|---|---|---|
| Weight (Kg) | 1 | 0.73 | 0.68 |
| Performance | OK | OK | OK |
| Process | OK | OK | OK |
| Material Only Cost | 1 | 0.91 | 0.86 |

TABLE 4

| Pugh Matrix | Mass Save Weighting (2) | Tooling Cost Weighting (1) | Piece Cost Weighting (1) | Integration Weighting (2) | Total | Mass | % Difference |
|---|---|---|---|---|---|---|---|
| Baseline | 0 | 0 | 0 | 0 | 0 | 1304.094 | 0 |
| FIGS. 1A-1C | 2 | −1 | 0 | 2 | 3 | 1032.7 | 20.81% |
| FIGS. 2A-2C | 2 | −1 | 0 | 2 | 3 | 945.347 | 27.51% |

More specifically, Table 4 depicts a Pugh Matrix in which mass weight savings are given a weighting of 2, and tooling costs, piece costs, and integration are each given a weighting of 1. Overall, because of the relative ease of manufacture, and decreased weight, the goose neck hinge assembly 10 of the present disclosure is better suited to the optimization criteria, relative to the baseline goose neck hinge. Thus, a goose neck hinge assembly 10 of the present disclosure offers several advantages including scalability, portability, durability, robustness, strength, and light weight, all while increasing ease of manufacture, lowering cost, and minimizing the number of independent assembly steps required.

The description of the present disclosure is merely exemplary in nature and variations that do not depart from the gist of the present disclosure are intended to be within the scope of the present disclosure. Such variations are not to be regarded as a departure from the spirit and scope of the present disclosure.

The following is claimed:

1. A goose neck hinge assembly for a motor vehicle, the goose neck hinge assembly comprising:

a base portion extending from a panel attachment portion to a hinge portion, the base portion having a substantially rectangular cross section; and wherein the base portion has a first structural element comprising a first material with a first material thickness and a second structural element comprising a second material with a second material thickness, wherein the first material thickness is different than the second material thickness, and wherein the first structural element forms a substantially U-shaped portion of the substantially rectangular cross section and defines a longitudinal gap, wherein the substantially U-shaped portion defined by the first structural element further comprises a semi-closed U-shaped portion having a first wall connected to a second wall, the second wall connected to a third wall, the third wall connected to a fourth wall, and the fourth wall connected to a fifth wall, and wherein the first and the fifth walls extend towards each other and define the longitudinal gap, and wherein the second structural element is disposed over the longitudinal gap.

2. The goose neck hinge assembly of claim 1 wherein at least one of the first structural element and the second structural element are roll-formed from sheet metal stock, and wherein the first structural element and the second structural element are bonded together, stretched, and bent into a predetermined shape having a lateral bend.

3. The goose neck hinge assembly of claim 1 wherein the first material is different than the second material.

4. The goose neck hinge assembly of claim 1 wherein the base portion further comprises a first section extending from the hinge portion to a second curvilinear section, and wherein the second section extends from the first section to a third section, and wherein the third section extends from the second section to the panel attachment portion.

5. The goose neck hinge assembly of claim 4 wherein the first section is substantially straight, the second section is substantially curvilinear, and the third section is substantially straight.

6. The goose neck hinge assembly of claim 1 wherein the first structural element is mechanically affixed to the second structural element.

7. The goose neck hinge assembly of claim 1 wherein the first structural element is chemically bonded to the second structural element.

8. The goose neck hinge assembly of claim 1 wherein the first material thickness is greater than the second material thickness.

9. The goose neck hinge assembly of claim 1 wherein the first structural element includes a plurality of attachment features for attaching the third section of the base portion to a moveable body panel of the motor vehicle.

10. The goose neck hinge assembly of claim 1 further comprising a mounting bracket mounted to the motor vehicle and rotatably connected to the hinge portion of the base portion, wherein the first structural element includes hinge attachment features accepting a pivot pin extending from the mounting bracket.

11. The goose neck hinge assembly of claim 1 wherein the substantially U-shaped portion is oriented vertically, and perpendicular to an axis of rotation of the goose neck hinge assembly.

12. A goose neck hinge assembly for a motor vehicle, the goose neck hinge assembly comprising:

a base portion extending from a panel attachment portion to a hinge portion, the base portion having a substantially rectangular cross section; and wherein the base portion has a first structural element comprising a first material with a first material thickness and a second structural element comprising a second material with a second material thickness different than the first material thickness; and wherein the first structural element forms a substantially U-shaped portion of the substantially rectangular cross section and defines a first longitudinal gap, and wherein the second structural element forms a substantially U-shaped portion of the substantially rectangular cross section and defines a second longitudinal gap, and wherein the first structural element is disposed within the second longitudinal gap and the second structural element is disposed over the longitudinal gap of the first structural element.

13. The goose neck hinge assembly of claim 12 wherein at least one of the first structural element and the second structural element is roll-formed from sheet metal stock, stretched, and bent into a predetermined shape, wherein the predetermined shape includes a lateral bend, and wherein the first structural element is mechanically or chemically affixed to the second structural element.

14. The goose neck hinge assembly of claim 12 wherein the base portion further comprises a first section extending from the hinge portion to a second curvilinear section, and wherein the second section extends from the first section to a third section, and wherein the third section extends from the second section to the panel attachment portion, and wherein the first section is substantially straight, the second section is substantially curvilinear, and the third section is substantially straight.

15. The goose neck hinge assembly of claim 12 wherein the first material is different than the second material.

16. The goose neck hinge assembly of claim 12 wherein the first structural element includes a plurality of attachment features for attaching the third section of the base portion to a moveable body panel of the motor vehicle.

17. The goose neck hinge assembly of claim 12 further comprising a mounting bracket mounted to the motor vehicle and rotatably connected to the hinge portion of the base portion, wherein the first structural element includes hinge attachment features accepting a pivot pin extending from the mounting bracket.

18. The goose neck hinge assembly of claim 17 wherein the mounting bracket is a metal extrusion having a substantially cylindrical central section integrally formed with a substantially planar flange, wherein the substantially cylindrical central section defines an inner substantially cylindrical passage for accepting a hinge pin, and wherein the substantially planar flange extends radially outward from substantially cylindrical central section, and wherein the substantially planar flange includes a plurality of attachment features for attaching the mounting bracket to the motor vehicle.

19. The goose neck hinge assembly of claim 12 further comprising a flexible bumper disposed on a top surface of the base portion proximate the hinge portion, wherein the flexible bumper limits rotation of the base portion relative to the motor vehicle.

20. The goose neck hinge assembly of claim 12 wherein the substantially U-shaped portion is oriented vertically, and perpendicular to an axis of rotation of the goose neck hinge assembly.

21. A goose neck hinge assembly for a motor vehicle, the goose neck hinge assembly comprising:

a base portion extending from a panel attachment portion to a hinge portion, the base portion having a substantially rectangular cross section; and a mounting bracket mounted to the motor vehicle and rotatably connected to the hinge portion of the base portion, wherein the base portion has a first roll-formed structural element comprising a first material with a first material thickness bonded to a second roll-formed structural element comprising a second material with a second material thickness different than the first material thickness, and wherein the first roll-formed structural element forms a substantially U-shaped portion of the substantially rectangular cross section and defines a first longitudinal gap, and wherein the second roll-formed structural element forms a substantially U-shaped portion of the substantially rectangular cross section and defines a second longitudinal gap, and wherein the first roll-formed structural element is disposed within the second longitudinal gap, and the second roll-formed structural element is disposed over the first longitudinal gap, and wherein the mounting bracket is an extrusion having an inner substantially cylindrical component concentrically and integrally extruded with an outer substantially cylindrical component and a substantially planar flange, wherein the inner substantially cylindrical component accepts the hinge pin, and the outer substantially cylindrical component is connected to the inner substantially cylindrical component by a plurality of radial ribs, and wherein the substantially planar flange extends radially outward from the outer substantially cylindrical component and includes a plurality of attachment features attaching the mounting bracket to the motor vehicle.

* * * * *